US009364068B2

(12) United States Patent
Kodama

(10) Patent No.: US 9,364,068 B2
(45) Date of Patent: Jun. 14, 2016

(54) HAIR ROOT APPLICATOR

(71) Applicant: Kao Corporation, Tokyo (JP)

(72) Inventor: Daisuke Kodama, Loveland, OH (US)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 14/476,862

(22) Filed: Sep. 4, 2014

(65) Prior Publication Data

US 2015/0101630 A1 Apr. 16, 2015

Related U.S. Application Data

(60) Provisional application No. 61/878,097, filed on Sep. 16, 2013.

(51) Int. Cl.
*A45D 24/22* (2006.01)
*A45D 24/26* (2006.01)
(Continued)

(52) U.S. Cl.
CPC ..... *A45D 24/26* (2013.01); *A45D 19/0008* (2013.01); *A45D 19/02* (2013.01); *A45D 24/22* (2013.01); *A45D 34/042* (2013.01); *A45D 2019/0083* (2013.01)

(58) Field of Classification Search
CPC ..... A45D 19/02; A45D 19/00; A45D 19/008; A45D 2019/0041; A45D 2019/005; A45D 2019/0066; A45D 2019/0083; A45D 2019/0091; A45D 2019/0033; A45D 24/22; A45D 24/26; A45D 2200/25; A45D 2200/00; A45D 2200/10; A45D 2200/057; A45D 2007/001; A45D 34/00; A45D 34/042; A45D 34/045; A45D 2034/002; A46B 2200/104; A46B 2200/1046; A46B 2200/00; A46B 5/0033; A46B 5/0037; A46B 5/02; A46B 15/00; A46B 9/023; A46B 9/028; A46B 7/02; A46B 7/023; A46B 7/026; A46B 11/00; A46B 11/0017; A46B 11/002; A46B 11/0041
USPC ..... 132/114, 200, 207, 208, 212, 107–113, 132/115, 116, 317, 320, 901, 902
See application file for complete search history.

(56) References Cited

U.S. PATENT DOCUMENTS 1,322,639 A * 11/1919 Snider et al. ..... 132/107
2,101,132 A * 12/1937 Daly et al. ..... 132/219
(Continued)

FOREIGN PATENT DOCUMENTS

JP 2001-046140 A 2/2001
JP 2001-046140 A 2/2001
(Continued)

*Primary Examiner* — Rachel Steitz
(74) *Attorney, Agent, or Firm* — Frost Brown Todd LLC

(57) ABSTRACT

A hair-root applicator (10) of the present invention includes: a comb-teeth part (13) in which a plurality of comb teeth (12) are erected from a surface of a comb-teeth base (14); and a container (11) for containing a hair dye as a coating agent. This hair-root applicator is an applicator capable of applying, to hair-root sections of the hair, the hair dye supplied from the container (11) to the comb teeth (12). Each comb tooth (12) includes a comb-tooth body part (15) having a function of combing the hair, and a tip-end elastically deformable part (16) that is provided contiguously to the tip end of the comb-tooth body part (15) and that is made of a soft resin. A liquid introduction path (17) for the coating agent is provided inside the comb-tooth body part (15). A discharge port (17*a*) of the liquid introduction path (17) is opened so as to be arranged in the vicinity of the tip-end elastically deformable part (16).

15 Claims, 6 Drawing Sheets

(51) Int. Cl.

| | |
|---|---|
| ***A45D 19/02*** | (2006.01) |
| ***A45D 19/00*** | (2006.01) |
| ***A45D 34/04*** | (2006.01) |

(56) References Cited

U.S. PATENT DOCUMENTS

| | | | | | |
|---|---|---|---|---|---|
| 2,170,550 | A | * | 8/1939 | Corel | 132/109 |
| 2,607,064 | A | * | 8/1952 | Sullivan et al. | 15/187 |
| 4,090,522 | A | * | 5/1978 | Donley et al. | 132/112 |
| 4,317,464 | A | * | 3/1982 | Bailey et al. | 132/113 |
| 5,054,504 | A | * | 10/1991 | Winrow | 132/114 |
| 5,188,132 | A | * | 2/1993 | Barkus | 132/219 |
| 5,291,905 | A | * | 3/1994 | Busch et al. | 132/116 |
| 5,311,887 | A | * | 5/1994 | Ramsey | 132/114 |
| 5,937,865 | A | * | 8/1999 | Dhaliwal | 132/114 |
| 6,047,703 | A | * | 4/2000 | Paglericcio et al. | 132/113 |
| 6,378,529 | B1 | * | 4/2002 | Clemente Marco | 132/111 |
| 6,457,476 | B1 | * | 10/2002 | Elmer et al. | 132/114 |
| 6,526,987 | B1 | * | 3/2003 | Gioia | 132/114 |
| 6,962,158 | B1 | * | 11/2005 | Anguelo | 132/113 |
| 7,000,618 | B2 | | 2/2006 | Dovergne et al. | |
| 7,059,333 | B2 | * | 6/2006 | Duqueroie | 132/114 |
| 7,409,957 | B2 | * | 8/2008 | Abergel | 132/114 |
| 8,047,735 | B2 | * | 11/2011 | Broadley et al. | 401/265 |
| 2003/0041869 | A1 | | 3/2003 | Dovergne et al. | |
| 2005/0257800 | A1 | * | 11/2005 | Inoue | 132/114 |
| 2007/0144550 | A1 | | 6/2007 | Roher | |
| 2007/0251537 | A1 | | 11/2007 | De Laforcade | |
| 2009/0269121 | A1 | * | 10/2009 | Snedden et al. | 401/183 |

FOREIGN PATENT DOCUMENTS

| | | | |
|---|---|---|---|
| JP | 2002-186516 | A | 7/2002 |
| JP | 2002-325622 | A | 11/2002 |

* cited by examiner

HAIR ROOT APPLICATOR

TECHNICAL FIELD

The present invention relates to a hair-root applicator including: a comb-teeth part in which a plurality of comb teeth are erected from a surface of a comb-teeth base; and a container for containing a coating agent.

BACKGROUND ART

A hair cosmetic applicator used for applying a hair cosmetic, such as a hair dye, onto the hair is a known example of a comb-teeth-equipped applicator wherein a coating agent fed from a container is discharged to a comb-teeth part having a plurality of comb teeth, and the comb teeth are used for applying the coating agent. Such a hair cosmetic applicator for hair cosmetics is used by removably attaching, to the mouth/neck part of a preferably squeezable container, a comb-teeth part in which a plurality of comb teeth are erected from the surface of a comb-teeth base. A hair cosmetic applicator for applying, for example, a hair dye as a hair cosmetic is configured such that a hair dye fed from a container can be discharged from a discharge port, which is formed e.g. in a comb-teeth base of a comb-teeth part, onto a region surrounded by a plurality of comb teeth, and the hair dye can be applied to the hair while combing the hair with the comb teeth (cf. Patent Literature 1, for example).

In other hair cosmetic applicators, discharge ports for discharging a hair dye are formed in each of the comb teeth of a comb-teeth part, so that hair dyeing can be performed easily in small areas or along the hairline (cf. Patent Literature 2 and Patent Literature 3, for example).

CITATION LIST

Patent Literature

Patent Literature 1: US 2003/41869 A1
Patent Literature 2: JP 2001-46140 A
Patent Literature 3: JP 2002-186516 A

SUMMARY OF INVENTION

The present invention is a hair-root applicator including: a comb-teeth part in which a plurality of comb teeth are erected from a surface of a comb-teeth base; and a container for containing a coating agent, wherein the hair-root applicator is capable of applying, to hair-root sections of the hair, the coating agent supplied from the container to the comb teeth. Each comb tooth includes a comb-tooth body part having a function of combing the hair, and a tip-end elastically deformable part that is provided contiguously to a tip end of the comb-tooth body part and that is made of a soft resin. The comb-tooth body part has a higher rigidity than the tip-end elastically deformable part, and has shape retaining (retainability) with which it is possible to comb and part the hair. A liquid introduction path for the coating agent is provided inside the comb-tooth body part. A discharge port of the liquid introduction path is opened so as to be arranged in the vicinity of the tip-end elastically deformable part, or arranged so as to contact or overlap the tip-end elastically deformable part.

BRIEF DESCRIPTION OF DRAWINGS

FIG. 5(*b*) is a cross-sectional view of a main part of a comb tooth as viewed from the major-axis direction of a comb-tooth body part.

FIG. 9(*b*) is an enlarged cross-sectional view of a tip end section of a comb tooth of the hair-root applicator according to the other embodiment.

FIG. 10(2) is an explanatory diagram illustrating how a coating agent is applied with the hair-root applicator according to the other embodiment.

FIG. 10(3) is an explanatory diagram illustrating how a coating agent is applied with the hair-root applicator according to the other embodiment.

DESCRIPTION OF EMBODIMENTS

Figure 1:
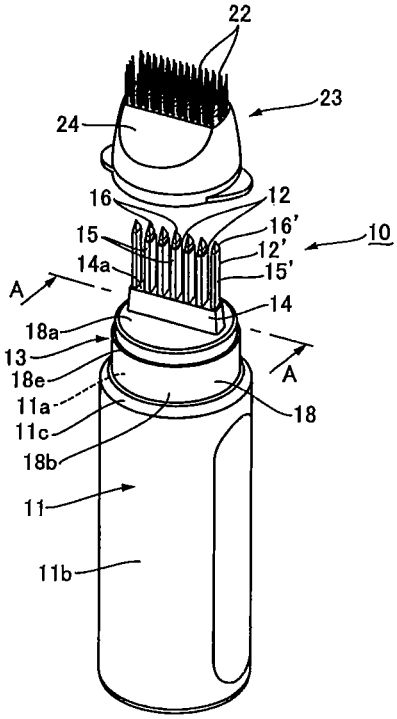
FIG. 1 is a perspective view of a hair-root applicator according to a preferred embodiment of the present invention.

The hair grows longer every day; so, for example, in a few weeks to a few months after dyeing the hair over the whole head uniformly and moderately, undyed regions—which are regions not yet dyed—will be created in sections at the roots of the hair. So, it would be convenient for the hair dye user if the undyed regions that have not yet been dyed in the hair-root sections can be dyed uniformly and evenly.

However, undyed regions in the hair-root sections are created simultaneously over the whole head, including sections where the user can see with his/her eyes, such as the hairline, as well as sections that cannot be seen, such as the top or back of the head. So, as for sections where it is difficult for the user to see the undyed regions with his/her eyes—e.g. the hair-root sections at the top and back of the head—it is difficult, for example, to dye the hair-root sections uniformly and evenly while combing and parting the hair.

The hair cosmetic applicators disclosed in Patent Literature 2 and Patent Literature 3 are capable of finely and uniformly dyeing undyed regions at sections that can be visually observed, such as at the hairline. However, with these hair cosmetic applicators, it is difficult to dye the hair-root sections uniformly and evenly in sections where it is difficult for the user to see the undyed regions with his/her eyes—e.g. in hair-root sections at the top and back of the head.

The present invention relates to a hair-root applicator that is capable of sufficiently supplying coating agents—such as hair cosmetics, e.g. hair dye, and other agents—up to the hair roots close to the scalp, even in hair-root sections where it is difficult for the user to see the undyed regions with his/her eyes—e.g. in hair-root sections at the top and back of the head—and that offers a pleasant feel to the scalp and is also capable of aiming at hair-root sections close to the scalp in applying the coating agent.

The present invention is a hair-root applicator including: a comb-teeth part in which a plurality of comb teeth are erected from a surface of a comb-teeth base; and a container for containing a coating agent, wherein the hair-root applicator is capable of applying, to hair-root sections of the hair, the coating agent supplied from the container to the comb teeth. Each comb tooth includes a comb-tooth body part having a function of combing the hair, and a tip-end elastically deformable part that is provided contiguously to a tip end of the comb-tooth body part and that is made of a soft resin. The comb-tooth body part has a higher rigidity than the tip-end elastically deformable part, and has shape retaining with which it is possible to comb and part the hair. "Shape retaining with which it is possible to comb and part the hair" preferably means shape retaining flexible so as to be flexible, but be not deformable when combing and parting hair. A liquid introduction path for the coating agent is provided inside the comb-tooth body part. A discharge port of the liquid introduction path is opened so as to be arranged in the vicinity of the tip-end elastically deformable part, or arranged so as to contact or overlap the tip-end elastically deformable part.

The present invention will be described below according to preferred embodiments thereof with reference to the drawings. FIG. 1 illustrates a hair-root applicator 10 according to a preferred embodiment of the present invention. This hair-root applicator 10 is configured by removably attachable to a comb-teeth part 13, which has a plurality of comb teeth 12, 12', to the mouth/neck part 11*a* (cf. FIG. 2) of a container 11 containing e.g. a hair dye, which is a hair cosmetic, as a coating agent. In the present embodiment, the body part 11*b* of the container 11 has flexibility that allows it to be pressed and deformed. A user can comb the hair with the comb teeth 12, 12' while discharging the hair dye fed to the comb-teeth part 13 and applying the hair dye to the hair, by holding the body part 11*b* and tilting the container 11 or turning it upside down and pressing (squeezing) the body part 11*b* in a state where, for example, the comb teeth 12, 12' are pushed against the scalp. The hair-root applicator 10 of the present embodiment: is capable of sufficiently supplying a hair dye up to the hair roots close to the scalp, even in hair-root sections where it is difficult for the user to see the undyed regions in the hair with his/her eyes; offers a pleasant feel to the scalp; and is capable of dyeing hair-root sections stably by allowing the hair dye to be applied easily by aiming at hair-root sections close to the scalp.

Figure 2:
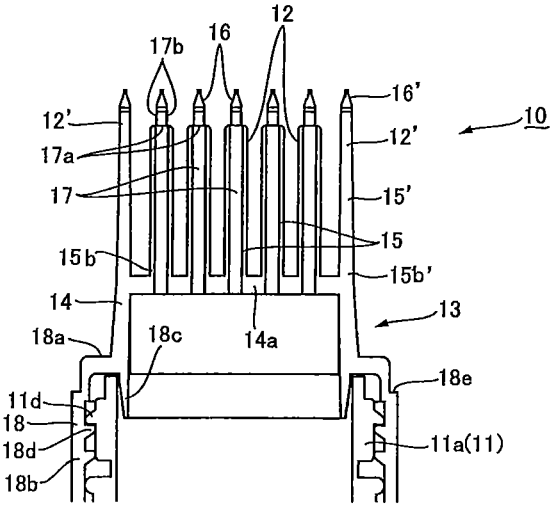
FIG. 2 is a cross-sectional view taken along A-A of FIG. 1.

As illustrated in FIGS. 1 and 2, the hair-root applicator 10 of the present embodiment includes: a comb-teeth part 13 in which a plurality of comb teeth 12, 12' are erected from a surface of a comb-teeth base 14; and a container 11 that contains a hair dye as a coating agent. This hair-root applicator 10 is an applicator capable of applying, to hair-root sections of the hair, the hair dye supplied from the container 11 to the comb teeth 12. Each comb tooth 12, 12' is constituted by including: a comb-tooth body part 15, 15' having a function of combing the hair; and a tip-end elastically deformable part 16, 16' that is provided contiguously to the tip end of the comb-tooth body part 15, 15' and that is made of a soft resin. It should be noted that, although an intermediate member may be provided between the comb-tooth body part 15, 15' and the tip-end elastically deformable part 16, 16', it is preferable that the comb tooth 12, 12' consists of the comb-tooth body part 15, 15' and the tip-end elastically deformable part 16, 16'. A liquid introduction path 17 for the coating agent is provided inside the comb-tooth body part 15. A discharge port 17*a* of the liquid introduction path 17 is opened so as to be arranged in the vicinity of the tip-end elastically deformable part 16, or arranged so as to contact or overlap the tip-end elastically deformable part 16.

Herein, as described further below, the comb tooth 12 is an intermediate comb tooth having a liquid introduction path 17 formed therein, and the comb tooth 12' is an end-section comb tooth that does not have a liquid introduction path 17 formed therein. The comb tooth 12 having a liquid introduction path 17 formed therein may be employed as the end-section comb tooth. The discharge port 17*a* of each liquid introduction path 17 is preferably provided only on the tip-end side of each comb tooth 12 from the viewpoint of improving applicability to hair-root sections, and is preferably formed in a side surface on the tip-end side.

Further, in the present embodiment, it is preferable that an auxiliary-comb-teeth part 23 is provided (cf. FIG. 1) so that the hair over the whole head can be dyed, regardless of the section of the hair. The auxiliary-comb-teeth part 23 is removably attachable to the comb-teeth part 13. The auxiliary-comb-teeth part 23 includes a plurality of auxiliary comb teeth 22 that are erected from an auxiliary-comb-teeth base 24. By attaching the auxiliary-comb-teeth part 23 to the comb-teeth part 13, the hair in such areas as the hairline, the temples, the neckline, or the nape can be dyed more neatly.

In the present embodiment, the container 11 is made of a synthetic resin, and is preferably a blow-molded article made of a synthetic resin including at least one type of resin selected from polypropylene, low-density polyethylene, medium-density polyethylene, and high-density polyethylene. The synthetic resin including at least one type of resin selected from polypropylene, low-density polyethylene, medium-density polyethylene, and high-density polyethylene may be a copolymer or a blend. The container 11 includes: a cylindrical body part 11*b* that has a bottom; and a mouth/neck part 11*a* that is provided contiguously to the upper-end section of the body part 11*b* via a shoulder part 11*c*, the upper end surface of the mouth/neck part 11*a* forming an outflow opening. The body part 11*b* has flexibility that allows it to be pressed (squeezed) and deformed. The outer peripheral surface of the mouth/neck part 11*a* is provided with a male thread 11*d* for removably attaching the comb-teeth part 13 or a cap. More specifically, a squeezable container or a delaminatable container may be used as the container.

When the hair-root applicator 10 is made into a product, the container 11 contains the hair dye's second agent, which is an acidic agent including e.g. a hydrogen peroxide solution, and a cap (not illustrated) is attached so as to cover the mouth/neck part 11*a*. The user who purchased the hair-root applicator 10 can form a hair dye by: removing the cap from the container 11; then adding a first agent, which is e.g. an alkaline agent, contained in another container such as a tube container; and mixing the first and second agents. Here, the first agent may be contained in the container 11, and the second agent may be contained in the other container. After forming the hair dye, the cap that has been re-attached during mixing is removed, and the comb-teeth part 13 is attached to the mouth/neck part 11*a* of the container 11, to obtain the hair-root applicator 10 of the present embodiment.

In the present embodiment, for example, a hair dye described in WO 2012/147858—i.e., a hair dye formed by mixing a composition A including an alkali agent and a composition B including an oxidizing agent, or a hair dye formed by mixing a composition A including an alkali agent, a composition B including an oxidizing agent, and a composition C including a powdery oxidation assistant—may preferably be used as the hair dye to be applied to the hair. The viscosity at 30° C. of the hair dye is preferably 3 mPa·s or greater—more preferably 5 mPa·s or greater, even more preferably 500 mPa·s or greater—and preferably 30000 mPa·s or less—more preferably 20000 mPa·s or less, even more preferably 15000 mPa·s or less. It should be noted that, if the container used in the present invention is a squeezable container, the viscosity of the hair dye at 30° C. is more preferably 1000 mPa·s or greater, and even more preferably 5000 mPa·s or greater. If the container used in the present invention is an aerosol container, the viscosity of the hair dye at 30° C. is more preferably 1000 mPa·s or greater, and even more preferably 5000 mPa·s or greater. The viscosity at 30° C. of the content liquid (hair dye) is the value found by rotating the agent for 1 minute at 30° C. at a rotation speed of 10 rpm with spindle No. T-C by using a viscometer (product of Toki Sangyo Co., Ltd.; Model: TVB-10R; T-Bar Stage: TS-10). In cases where the viscosity is 2000 mPa·s or less, the viscosity is the value found by rotating the agent for 1 minute at 30° C. at a rotation speed of 30 rpm with spindle No. 4 by using a Model TVB-10M viscometer (product of Toki Sangyo Co., Ltd.). In cases where the viscosity is 1000 mPa·s or less, the viscosity is the value measured with a SV-type viscometer (product of A&D Co., Ltd.; Model SV-10; natural frequency: 30 Hz).

It should be noted that, in cases where the coating agent contained in the container 11 is a liquid agent—such as a hair tonic, a hair restorer, or a scalp care agent—or an emulsion or oil, it is preferable that the viscosity of the hair dye at 30° C. is preferably 0.5 mPa·s or greater—more preferably 1 mPa·s or greater, even more preferably 5 mPa·s or greater—and preferably 10000 mPa·s or less—more preferably 5000 mPa·s or less, even more preferably 2000 mPa·s or less, and further preferably 1000 mPa·s or less—from the viewpoint of sufficiently spreading the agent over the scalp and from the viewpoint of preventing dripping and improving applicability.

In the present embodiment, the comb-teeth part 13 is constituted by a synthetic resin, and is preferably an injection-molded article made by coinjection molding or insert molding. The comb-teeth part 13 includes: a comb-teeth base 14; a plurality of comb teeth 12, 12' that are erected from the surface (upper surface) of the comb-teeth base 14; and an attachment skirt part 18 provided contiguously to the lower-end section of the comb-teeth base 14. The various parts—i.e., the comb-tooth body parts 15, 15' of the respective comb teeth 12, 12', the comb-teeth base 14, and the attachment skirt part 18—except for the tip-end elastically deformable parts 16, 16' at the respective tip end sections of the comb teeth 12, 12' are preferably formed by using a synthetic resin including at least one type of resin selected from polypropylene, medium-density polyethylene, and high-density polyethylene; and are more preferably formed by using a synthetic resin including one or two types of resin(s) selected from polypropylene and high-density polyethylene; and even more preferably formed by using a synthetic resin consisting of one or two types of resin(s) selected from polypropylene and high-density polyethylene.

The soft resin forming the tip-end elastically deformable part 16, 16' at the tip end section of each comb tooth 12, 12' is preferably one type of resin, or a mixture of two or more types of resins, selected from elastic resin materials or soft resin materials including at least one type of rubber component or elastomer component selected from polystyrene, polyolefin, polyester, polyurethane, urethane rubber, and silicone rubber, and is preferably an elastomer preferably including an elastomer component, and more preferably including polystyrene. The tip-end elastically deformable part 16, 16' at the tip end section of each comb tooth 12, 12' is formed by using a synthetic resin that elastically deforms and bends by being pressed against the scalp. The tensile strength thereof measured according to JIS K 6251 (2010) is preferably 1 MPa or greater—more preferably 2 MPa or greater—and preferably 10 MPa or less—more preferably 8 MPa or less.

The synthetic resin forming the comb-tooth body part 15, 15' is preferably a synthetic resin that includes at least one type of resin selected from medium-density polyethylene, high-density polyethylene, and polypropylene, and is preferably a synthetic resin that mainly includes one or two types of resin(s) selected from high-density polyethylene and polypropylene, and is preferably a synthetic resin consisting of one or two types of resin(s) selected from high-density polyethylene and polypropylene. The tensile strength of the comb-tooth body part 15, 15' as measured according to D638/651 is preferably greater than 10 MPa—more preferably 15 MPa or greater, even more preferably 20 MPa or greater—and preferably 50 MPa or less—more preferably 40 MPa or less—from the viewpoint of providing the comb teeth 12, 12' with a function of combing the hair, while allowing the comb teeth 12, 12' to be flexible without causing distortion or deformation.

The difference in tensile strength between the comb-tooth body part 15, 15' and the tip-end elastically deformable part 16, 16' is preferably from 5 MPa to 40 MPa, more preferably from 10 MPa to 35 MPa, and even more preferably from 15 MPa to 35 MPa, from the viewpoint of sufficiently supporting the deformation of the tip-end elastically deformable parts 16, 16' while providing the comb teeth 12, 12' with a function of combing the hair.

The tip-end elastically deformable part 16, 16' is formed by using a synthetic resin that elastically deforms and bends by being pressed against the scalp. The longitudinal elastic modulus (Young's modulus) of the tip-end elastically deformable part 16, 16' is preferably 0.5 MPa or greater—more preferably 1 MPa or greater, even more preferably 3 MPa or greater—and preferably 50 MPa or less—more preferably 40 MPa or less, even more preferably 30 MPa or less. On the other hand, the tensile modulus of elasticity of the comb-tooth body part 15, 15' as measured according to D638 is preferably 200 MPa or greater—more preferably 400 MPa or greater, even more preferably 800 MPa or greater—and preferably 2000 MPa or less—more preferably 1500 MPa or less—from the viewpoint of providing the comb teeth 12, 12' with a function of combing the hair, while allowing the comb teeth 12, 12' to be flexible without causing distortion or deformation. Note that the longitudinal elastic modulus (Young's modulus) of the tip-end elastically deformable part 16, 16' is found according to JIS K 6251 (2010) by: preparing a JIS No. 3 dumbbell-shaped sample; obtaining a stress-strain curve; and finding the slope of the tangent to the curve in the initial strain region.

The difference between the tensile modulus of elasticity of the comb-tooth body part 15, 15' and the longitudinal elastic modulus of the tip-end elastically deformable part 16, 16' is preferably from 200 MPa to 1950 MPa, more preferably from 400 MPa to 1460 MPa, and even more preferably from 800 to 1460 MPa, from the viewpoint of sufficiently supporting the deformation of the tip-end elastically deformable parts 16, 16' while providing the comb teeth 12, 12' with a function of combing the hair.

The tip-end elastically deformable part 16, 16' and the comb-tooth body part 15, 15' may differ not only in terms of physical properties, but also in terms of color. By coloring the tip-end elastically deformable part 16, 16' with a different color from the comb-tooth body part 15, 15', the two parts can be distinguished from one another, and the discharge port etc. can be cleaned easily. Further, the user can recognize the tip-end elastically deformable parts 16, 16', thus prompting the user to actively press the tip-end elastically deformable parts 16, 16' against his/her scalp.

The attachment skirt part 18 of the comb-teeth part 13 includes: a top-surface plate 18*a* having a circular flat shape; a tubular attachment part 18*b* that extends downward from the peripheral edge section of the top-surface plate 18*a*, and that has a substantially cylindrical shape; and an annular inner-ring part 18*c* that is arranged concentrically with the tubular attachment part 18*b* on the inner side thereof, and that protrudes downward from the lower surface of the top-surface plate 18*a*. A female thread 18*d*, which is screwed to the male thread 11*d* formed on the outer peripheral surface of the mouth/neck part 11*a* of the container 11, is provided to the inner peripheral surface of the tubular attachment part 18*b*. When the comb-teeth part 13 is attached to the mouth/neck part 11*a* of the container 11, the inner-ring part 18*c* tightly contacts the inner peripheral surface at the upper-end section of the mouth/neck part 11*a*, and can thus maintain excellent liquid-leak preventiveness. Further, the upper-end section of the tubular attachment part 18*b* is provided with an engagement step part 18*e* that engages with a lower-end engaging part of the later-described auxiliary-comb-teeth part 23 when the auxiliary-comb-teeth part 23 is attached over the comb-teeth part 13.

In the present embodiment, the comb-teeth base 14 of the comb-teeth part 13 is arranged so as to radially traverse the central section of the circular top-surface plate 18*a* of the attachment skirt part 18, and is provided so as to protrude upward from the top-surface plate 18*a*. The comb-teeth base 14 has a rectangular, hollow cross-sectional shape that is in communication with the mouth/neck part 11*a* of the container 11 and that has, on the upper surface thereof, an erection base plate 14*a* from which the comb teeth 12, 12' are erected. The erection base plate 14*a* of the comb-teeth base 14 has a horizontally-long strip-like shape. The plurality of comb teeth 12, 12' are erected upward from the erection base plate 14*a*.

In the present embodiment, the comb teeth 12, 12' of the comb-teeth part 13 include: a pair of end-section comb teeth 12' arranged at respective end sections, in the length direction, of the erection base plate 14*a*; and five intermediate comb teeth 12 arranged between the pair of end-section comb teeth 12'. Each of the comb teeth 12, 12' includes: a comb-tooth body part 15, 15' that has the function of combing the hair by having a shape-retainable rigidity (shape retainability) capable of combing and parting the hair; and a tip-end elastically deformable part 16, 16' that is provided contiguously to the tip end of the comb-tooth body part 15, 15' and that is made of a flexible soft resin. A liquid introduction path 17 that is in communication with the hollow interior of the comb-teeth base 14 is formed inside each intermediate comb tooth 12. The comb teeth 12, 12' are: preferably selected from comb teeth in which the comb-tooth body part 15, 15' and the tip-end elastically deformable part 16, 16' are fixed by fitting, comb teeth in which the comb-tooth body part and the tip-end elastically deformable part are fixed by screwing, and comb teeth in which the comb-tooth body part and the tip-end elastically deformable part are coinjection-molded or insert-molded; and, more preferably, comb teeth in which the comb-tooth body part and the tip-end elastically deformable part are coinjection-molded or insert-molded; and, even more preferably, comb teeth in which the comb-tooth body part and the tip-end elastically deformable part are coinjection-molded.

The entire height-wise length of the comb tooth 12, 12', including the comb-tooth body part 15, 15' and the tip-end elastically deformable part 16, 16', is preferably from 15 to 25 mm, and more preferably from 18 to 23 mm, from the viewpoint of improving the function of combing and parting the hair. The height-wise length of the tip-end elastically deformable part 16, 16' is preferably from 1.0 to 5.5 mm, and more preferably from 1.5 to 4.0 mm. The ratio of the height-wise length of the tip-end elastically deformable part 16, 16' with respect to the entire length of the comb tooth 12, 12' is preferably from 0.05 to 0.35, and more preferably from 0.07 to 0.2. The spacing kept between adjacent comb teeth 12, 12' is preferably from 1 to 8 mm, and more preferably from 2 to 4 mm. The "spacing kept between adjacent comb teeth 12, 12'" is the shortest distance between the base sections (root sections) of the respective comb teeth 12, 12', and in cases where the comb tooth 12, 12' has, for example, a tapered shape, the spacing between the base sections does not have to be maintained at the tip ends of the comb teeth 12, 12'.

In the present embodiment, the comb-tooth body part 15, 15' of each comb tooth 12, 12' has a flat cross-sectional shape having a major axis and a minor axis. A plurality of the comb teeth 12, 12' are arranged such that the major-axis directions of the respective comb-tooth body parts 15, 15' are parallel to one another, and the comb teeth 12, 12' are provided so as to be lined up with spacings therebetween in the minor-axis directions of the respective comb-tooth body parts 15, 15', preferably at a regular center-to-center pitch of from 3 to 8 mm, and more preferably at a regular center-to-center pitch of from 4 to 6 mm (the center-to-center pitch is 5 mm in the present embodiment). It should be noted that the center-to-center pitches between the plurality of lined-up comb teeth 12, 12' may differ from one another, and the number of comb teeth 12, 12' is not limited to the number illustrated in the drawings. It should be noted that the "center-to-center pitch" refers to the distance between the respective axial centers of the comb teeth 12, 12'.

Further, in the present embodiment, the entire shape including both the comb-tooth body part 15, 15' and the tip-end elastically deformable part 16, 16' of each comb tooth 12, 12' has a tapered shape in which the cross-sectional area decreases from its base end section 15*b*, 15*b'* (cf. FIG. 2) on the side of the comb-teeth base 14 toward the tip end of the tip-end elastically deformable part 16, 16'. More specifically, for example, the entire shape of the comb-tooth body part 15, 15' and the tip-end elastically deformable part 16, 16' is formed so as to have a vertically-long, substantially isosceles-triangular front shape. Alternatively, the comb teeth 12, 12' may have a vertically-long, substantially triangular front shape in which the lengths of the respective oblique sides of the comb-tooth body part 15, 15' are different.

The tip-end elastically deformable part 16, 16', which is provided contiguously to the tip end of the comb-tooth body part 15, 15' and which is made of a soft resin, has a pointed shape in which the cross-sectional area of the elastic deformation part gradually decreases toward its tip end section. More specifically, for example, the tip-end elastically deformable part 16, 16' is formed so as to have a substantially isosceles-triangular front shape. Alternatively, the tip-end elastically deformable part 16, 16' may have a substantially triangular front shape in which the lengths of the respective oblique sides are different. The comb tooth 12, 12' is preferably made such that the comb-tooth body part 15, 15' has a cross-sectional area gradually decreasing on its tip-end side, and is contiguous to the tip-end elastically deformable part 16, 16' having a pointed shape in which the cross-sectional area gradually decreases toward its tip end section.

Furthermore, in the present embodiment, as illustrated in FIG. 2, the discharge port 17*a* of the liquid introduction path 17, which is formed inside each intermediate comb tooth 12, is opened in the tip end section of the comb-tooth body part 15 so as to be arranged in the vicinity of the tip-end elastically deformable part 16. Here, the discharge port 17*a* may be opened only in a section of the comb-tooth body part 15, or may be opened so as to contact the tip-end elastically deformable part 16, or may be arranged so as to overlap the tip-end elastically deformable part 16 such that a portion of the discharge port 17*a* is connected thereto. Because the tip-end elastically deformable part 16 is a flexible section constituted by a soft resin, it is generally difficult to form a discharge port therein, but it is possible to partially provide a discharge port.

In the present embodiment, the position of the discharge port 17*a*'s end section on the tip end side—which is the height-wise position where the discharge port 17*a* is opened—is preferably included in a height-wise region that is from 1.0 to 5.5 mm, and more preferably from 1.5 to 4.0 mm, from the tip end of the tip-end elastically deformable part 16. The shape of the opening of the discharge port 17*a* may be, for example, rectangular, circular, elliptic, or triangular. The inner diameter of the discharge port 17*a* is preferably from 1.0 to 3.0 mm, and more preferably from 1.5 to 2.5 mm. The width of the opening of the discharge port 17*a* in a direction orthogonal to the height direction, which is the axial direction of the comb-tooth body part 15, is preferably from 1.0 to 3.0 mm, and more preferably from 1.5 to 2.5 mm. The area of the opening of the discharge port 17*a* is preferably from 0.77 to 7.06 $mm^2$, and more preferably from 1.0 to 3.5 $mm^2$.

The cross-sectional shape of the liquid introduction path 17 formed inside each intermediate comb tooth 12 may be, for example, circular, rectangular, elliptic, triangular, or keyhole shaped. The inner diameter of the liquid introduction path 17 (or the width thereof in a direction orthogonal to the height direction of the comb-tooth body part 15) is preferably from 0.5 to 4.0 mm, and more preferably from 1.5 to 2.5 mm.

The width, in the minor-axis direction, of the comb-tooth body part 15 of each intermediate comb tooth 12 in a section where the liquid introduction path 17 is formed is preferably from 1.5 to 4.5 mm, and more preferably from 2.0 to 3.0 mm. The ratio of the inner diameter of the liquid introduction path 17 to the width, in the minor-axis direction, of the comb-tooth body part 15 is preferably from 0.2 to 0.75, and more preferably from 0.5 to 0.7.

Figure 3:
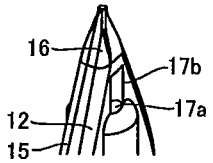
FIG. 3 is an enlarged perspective view of a tip end section of a comb tooth.
Figure 4:
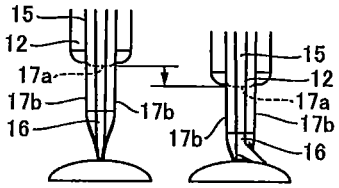
FIG. 4 is an explanatory diagram illustrating how a coating agent is applied while elastically deforming the tip-end elastically deformable part.
Figure 5A:
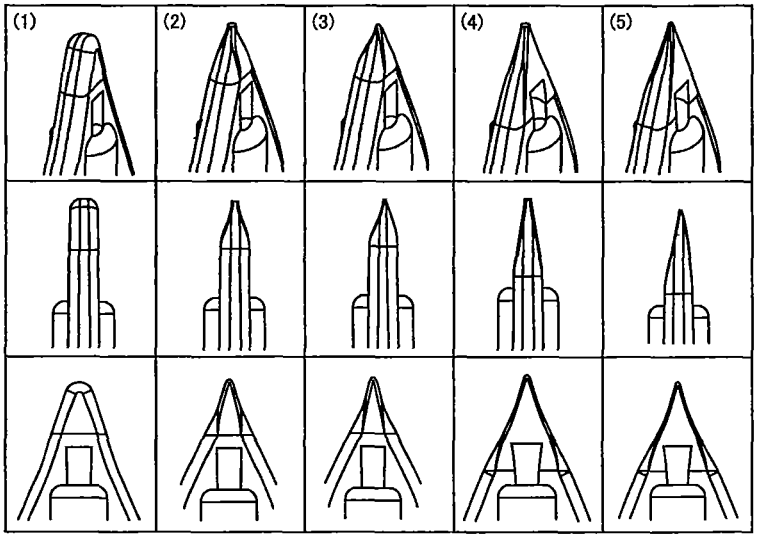
FIG. 5(*a*) is a diagram illustrating various examples of shapes of the tip-end elastically deformable part and branched discharge ports provided to the tip end section of a comb tooth.
Figure 5B:
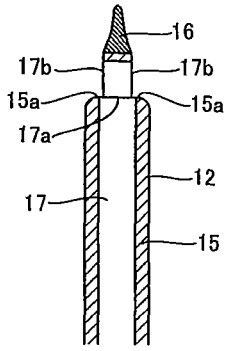

Further, in the present embodiment, as illustrated in FIGS. 3, 4, and 5(*b*), each intermediate comb tooth 12 has a plurality of branched discharge ports 17*b* that branch off from the discharge port 17*a* of the liquid introduction path 17 on the tip-end side, and that each open in a surface of the comb tooth. The branched discharge ports 17*b* are also arranged in the vicinity of the tip-end elastically deformable part 16, and are opened in the tip end section of the comb-tooth body part 15. It is preferable that the branched discharge ports 17*b* are provided in a pair and are arranged back-to-back along the minor-axis direction of the comb-tooth body part 15, which has a flat, horizontally-long transverse cross-sectional shape having a major axis and a minor axis.

Furthermore, in the present embodiment, the plurality of the tip-end elastically deformable parts 16 and the branched discharge ports 17*b* of the respective comb teeth 12, 12', which are provided with spacings therebetween in the minor-axis direction of the respective comb-tooth body parts 15, 15', are provided so as to be lined up on a single straight line along the minor-axis direction of the respective comb-tooth body parts 15, 15'.

With the hair-root applicator 10 of the present embodiment having the aforementioned configuration, it is possible to supply the hair dye easily up to the hair roots close to the scalp, even in hair-root sections where it is difficult for the user to see the undyed regions with his/her eyes—e.g. in hair-root sections at the top and back of the head—and thus, dye hair-root sections stably by allowing the hair dye to be applied by aiming at hair-root sections close to the scalp.

More specifically, according to the present embodiment: each comb tooth 12, 12' of the comb-teeth part 13 is constituted by including a comb-tooth body part 15, 15' having a function of combing the hair, and a tip-end elastically deformable part 16, 16' that is provided contiguously to the tip end of the comb-tooth body part 15, 15' and that is made of a soft resin; a liquid introduction path 17 for the coating agent is provided inside the comb-tooth body part 15; and a discharge port 17*a* of the liquid introduction path 17 is opened in the tip end section close to the tip-end elastically deformable part 16. Thus, it is possible to apply the coating agent supplied from the discharge port 17*a* of the liquid introduction path 17 of each comb-tooth body part 15 to the vicinity of the tip-end elastically deformable part 16, 16' while pressing the tip-end elastically deformable parts 16, 16' against the scalp and elastically deforming the tip-end elastically deformable parts at the same time as combing the hair with the comb-tooth body parts 15, 15', thereby allowing the coating agent to be applied up to sections close to the hair roots.

Thus, according to the present embodiment, when the hair dye is applied to the hair by squeezing the body part 11*b* in a state where the comb teeth 12, 12' are pushed against the scalp while the user is holding the body part 11*b*, the comb-tooth body parts 15, 15' can comb and part the hair easily even in areas where the hair is voluminous, and also, the tip end sections of the comb teeth 12, 12' can be pushed against the scalp by means of the flexible tip-end elastically deformable parts 16, 16'. After pushing the flexible tip-end elastically deformable parts 16, 16' against the scalp, by further applying a force that presses them further against the scalp, the tip-end elastically deformable parts 16, 16' are elastically deformed so as to be flattened as illustrated in FIG. 4, or elastically deformed so as to be bent back toward the opposite side from the direction in which the hair is combed, and thus, the discharge port 17*a* and the branched discharge ports 17*b* of the liquid introduction path 17 of each comb tooth 12 can be brought even closer to the scalp. Thus, the area of contact against the scalp can be increased, and the force by which the comb teeth 12, 12' are pressed against the user's scalp can be dispersed. Further, for example, by squeezing the body part 11*b* and discharging the hair dye while further applying a force that presses the tip-end elastically deformable parts 16, 16' of the comb teeth 12, 12' further against the scalp after pushing the tip-end elastically deformable parts 16, 16' against the scalp and positioning the same, it is possible to apply the hair dye and dye the hair roots in a stable state by supplying the hair dye while aiming at hair-root sections where the undyed regions are difficult to see with the eyes—such as in hair-root sections at the top and back of the head. Further, because the tip-end elastically deformable part 16 has an elastically deformable structure, the tip-end elastically deformable part 16 can be provided with sufficient strength, even when the discharge port 17*a* is arranged in the vicinity of the tip-end elastically deformable part 16, or arranged at a position contacting or overlapping the tip-end elastically deformable part 16.

Further, according to the present embodiment, because the tip-end elastically deformable part 16, 16' attached to the tip end of the comb-tooth body part 15, 15' of each comb tooth 12, 12' is flexible, it is possible to maintain a soft feel to the scalp, even if the tip-end elastically deformable part 16, 16' is formed in a pointed shape in which the cross-sectional area thereof gradually decreases toward its tip end section. Thus, the user is less prone to feel pain on his/her scalp, and also, the tip-end elastically deformable parts 16, 16' can be made even more elastically-deformable and can maintain a soft feel. Further, it is possible to comb the hair while smoothly pushing the tip end sections of the tip-end elastically deformable parts 16, 16' against desired positions of the scalp, without irritating the scalp, and also, the hair dye can be applied by bringing the discharge port 17*a* and the branched discharge ports 17*b* even closer to the scalp.

FIG. 5(*a*) is a diagram illustrating examples of various shapes of the tip-end elastically deformable part 16 and the branched discharge port 17 provided at the tip end section of each comb-tooth body part 15. In the diagram of FIG. 5, the upper stage shows perspective views, the middle stage shows side views, and the lower stage shows front views. Columns (1) to (3) show examples in which the comb-tooth body part and the tip-end elastically deformable part are coinjection-molded, and columns (4) and (5) show examples in which they are insert-molded. As illustrated in FIG. 5(*a*), the tip end section of the tip-end elastically deformable part may be formed so as to be rounded (cf. (1)). Further, the branched discharge port may be formed so as to extend over the comb-tooth body part and the tip-end elastically deformable part (cf. (4) and (5)). If the tip-end elastically deformable part has a pointed tip-end shape, its tip end section is easy to bend, but the scalp will be stimulated. On the other hand, by rounding the tip end shape of the tip-end elastically deformable part in a curved shape, the tip-end elastically deformable part can be made into a shape that is less irritating to the scalp, although the elastic deformation part becomes harder to bend.

Further, as illustrated in FIG. 5(*b*), when the comb tooth 12 is viewed from the major-axis direction of the comb-tooth body part 15, it is preferable that the comb-tooth body part 15 of the comb tooth 12 has a stepped part 15*a*, in which the width of the comb-tooth body part 15 is narrowed, in the vicinity of the tip-end elastically deformable part 16. In this way, the combing capability of the comb teeth 12 can be improved by slimming down the tip end shape of the comb-tooth body parts 15 (i.e., reducing the thickness/width thereof), and also, a sufficient width in the minor-axis direction of the comb-tooth body part 15 can be ensured in sections below the discharge port 17*a*. Further, by forming the comb-tooth body part 15 by using a resin that has a higher rigidity than the resin used for the tip-end elastically deformable part 16, a liquid introduction path 17 can be formed inside the comb-tooth body part, and the comb tooth 12 can be provided with a shape-retainable rigidity necessary for combing and parting the hair. Furthermore, it is preferable that the discharge ports 17*b* are opened in the side surfaces of the comb tooth 12 more toward the tip-end side of the comb tooth 12 than the stepped part 15*a*. In this way, the discharge ports 17*b* can be provided in a region having a small cross-sectional area on the tip-end side of the comb tooth 12 while ensuring a sufficient cross-sectional area and cross-sectional diameter for the liquid introduction path 17. Further, the hair dye fed from the container 11 into the liquid introduction path 17 and discharged from the discharge ports 17*b* is prevented from spreading toward the side of the comb-tooth body parts 15, 15'—i.e., toward the side of the base sections of the respective comb-tooth body parts 15, 15'—and can be discharged toward the scalp more easily, thus further facilitating the application of the hair dye toward the direction of the scalp.

As described above, the comb teeth 12 achieve good hair-dye dischargeability, combing capability, and shape-retainable rigidity for combing the hair.

Figure 6:
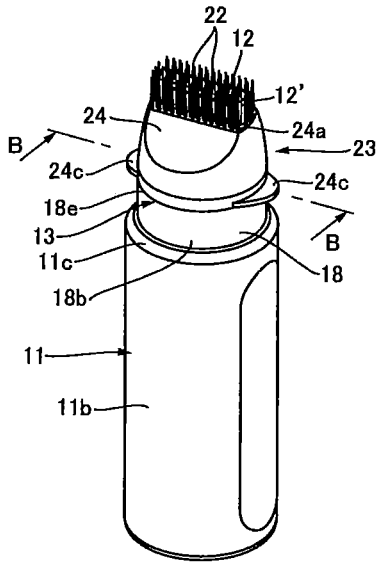
FIG. 6 is a perspective view of a hair-root applicator in a state where an auxiliary-comb-teeth part is attached.

In the present embodiment, the auxiliary-comb-teeth part 23 is provided as illustrated in FIGS. 1 and 6, so that it is possible to dye not just the hair-root sections, but also the hair over the whole head—including hair in such areas as the hairline, the nape, or the temples—regardless of the section of the hair. The auxiliary-comb-teeth part 23 is formed by injection molding by using a synthetic resin, such as polyethylene or polypropylene.

Figure 7:
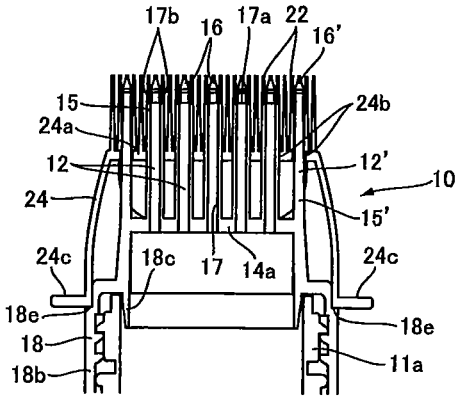
FIG. 7 is a cross-sectional view taken along B-B of FIG. 6.

As illustrated in FIG. 7, the auxiliary-comb-teeth part 23 has, on the upper surface of the auxiliary-comb-teeth base 24, an auxiliary erection base plate 24*a* that has a horizontally-long strip-like shape, like the erection base plate 14*a* on the comb-teeth base 14 of the comb-teeth part 13, and that is larger than the erection base plate 14*a*. A plurality of comb-tooth insertion openings 24*b* are opened in the auxiliary erection base plate 24*a* at positions corresponding to the plurality of comb teeth 12, 12' erected from the comb-teeth base 14 of the comb-teeth part 13. The comb-tooth insertion opening 24*b* is formed so as to have the same opening shape as—and be slightly larger than—the cross-sectional shape of the comb tooth 12, 12' at its height-wise middle section. Like the comb teeth 12, 12' of the comb-teeth part 13, the comb-tooth insertion openings 24*b* are opened at seven points at a regular center-to-center pitch, with spacings therebetween in the length direction of the auxiliary erection base plate 24*a*, which is the minor-axis direction of the respective comb-tooth insertion openings 24*b*.

A multitude of auxiliary comb teeth 22 are erected from the auxiliary erection base plate 24*a* which is on the upper surface of the auxiliary-comb-teeth base 24. In the present embodiment, each auxiliary comb tooth 22 is a protrusion having a narrow, long, circular-cone shape. The auxiliary comb teeth 22 are provided contiguously in a rectangular annular shape along the peripheral edge section of the auxiliary erection base plate 24*a* so as to surround all of the comb-tooth insertion openings 24*b* provided at seven points. Also, a plurality of auxiliary comb teeth 22 are erected in the spacings between respective pairs of adjacent comb-tooth insertion openings 24*b*, which are provided at seven points.

The auxiliary-comb-teeth base 24 of the auxiliary-comb-teeth part 23 has a substantially-hemispherical dome shape, with sections along the long sides of the auxiliary erection base plate 24*a* sunken-in in a concave shape. The inner diameter of the auxiliary-comb-teeth base 24 at its lower-end section matches the outer diameter of the engagement step part 18*e*, which is formed in the upper-end section of the tubular attachment part 18*b* of the attachment skirt part 18 of the comb-teeth part 13. By employing the lower-end section of the auxiliary-comb-teeth base 24 as the lower-end engaging part and fitting the lower-end section onto the engagement step part 18*e*, the auxiliary-comb-teeth part 23 is attached over the comb-teeth part 13 in a state where the comb teeth 12, 12' are inserted up to their middle sections through the respective comb-tooth insertion openings 24*b*. A pair of finger-grip ribs 24*c* is provided so as to project outward from the lower-end edge section of the auxiliary-comb-teeth base 24 along the length direction of the auxiliary erection base plate 24*a*. By holding the finger-grip ribs 24*c* with the fingers, the attachment/removal of the auxiliary-comb-teeth part 23 to/from the comb-teeth part 13 can be performed more smoothly.

By using the applicator with the auxiliary-comb-teeth part 23 attached to the comb-teeth part 13, the auxiliary-comb-teeth part 23 can grasp a greater amount of hair. Thus, while the hair dye discharged from the tip-end side of the comb-teeth part 13 is being received by, or coated onto, the tip end of the auxiliary-comb-teeth part 23, areas such as the hairline between the face and the scalp, the temples, or the neckline/nape can be dyed neatly, even with a single stroke, while delivering the hair dye to a greater amount of hair. In the present embodiment, the presence of the tip-end elastically deformable parts 16, 16' at the tip end of the comb-teeth part 13 allows the hair dye to be supplied further toward the tip-end side of the comb-teeth part 13, thus making it possible to dye the hair roots neatly even in areas such as the hairline.

As described above, in the present embodiment, a plurality of auxiliary comb teeth 22 are erected in the spacing between each pair of adjacent comb-tooth insertion openings 24*b*, which are provided in the auxiliary erection base plate 24*a* of the auxiliary-comb-teeth base 24. Thus, in a state where the auxiliary-comb-teeth part 23 is attached to the comb-teeth part 13, the auxiliary comb teeth 22 are arranged in the spacing between each pair of comb teeth 12, 12' of the comb-teeth part 13 that are adjacent to one another in the minor-axis direction. Further, in this way, the hair dye discharged from the discharge ports 17*a* and/or the branched discharge ports 17*b*, which are formed in the comb teeth 12 of the comb-teeth part 13, can be held easily in the spacings between respective pairs of comb teeth 12, 12' where the auxiliary comb teeth 22 are interposed, and thus, the hair over the whole head can be dyed more stably, uniformly, and evenly.

Further, in the present embodiment, in a state where the auxiliary-comb-teeth part 23 is attached to the comb-teeth part 13, the height-wise position of the tip end of the tip-end elastically deformable part 16, 16' of each comb tooth 12, 12' of the comb-teeth part 13 is the same as or above the height-wise position of the tip end of each auxiliary comb tooth 22. By setting the height-wise position of the tip end of the tip-end elastically deformable part 16, 16' of each comb tooth 12, 12' to a position that is the same as or above the height-wise position of the tip end of each auxiliary comb tooth 22, the tip ends of the auxiliary comb teeth 22 contact the sections to be coated (i.e., the scalp) without leaving any space therebetween, and the hair dye discharged from the vicinity of the tip-end elastically deformable parts 16 is supplied easily to the tip-end side of the auxiliary comb teeth 22, thus making it possible to apply the hair dye even more uniformly and neatly.

Figure 8:
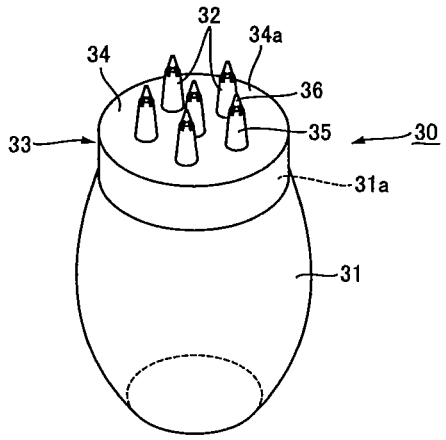
FIG. 8 is a perspective view of a hair-root applicator according to another preferred embodiment of the present invention.

FIG. 8 illustrates a hair-root applicator 30 according to another embodiment of the present invention. The hair-root applicator 30 according to this other embodiment is configured by removably attaching a comb-teeth part 33, which has a plurality of comb teeth 32, to the mouth/neck part 31*a* of a container 31 containing e.g. a hair dye or a bleach, which is a hair cosmetic, as a coating agent. In the hair-root applicator 30 of this other embodiment, the comb-teeth base 34 has a flat, ceilinged cylindrical shape having a circular erection base plate 34*a* on the upper surface thereof. The comb teeth 32 preferably include: a comb tooth 32 arranged in the center; and a plurality of comb teeth 32 arranged concentrically about the central comb tooth 32. In the embodiment of FIG. 8, substantially circular-cone-shaped comb teeth 32 are erected upward from the circular erection base plate 34*a* at a total of six points—i.e., one in the center and five therearound.

Figure 9A:
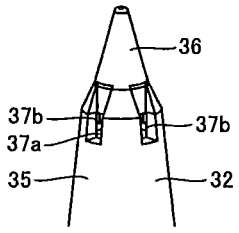
FIG. 9(*a*) is an enlarged perspective view of a tip end section of a comb tooth of the hair-root applicator according to the other embodiment.
Figure 9B:
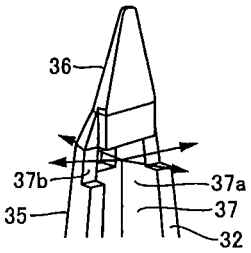

As illustrated in FIGS. 9(*a*) and 9(*b*), each comb tooth 32 is constituted by: a substantially truncated-cone-shaped comb-tooth body part 35 that has the function of combing the hair by having a shape-retainable rigidity capable of combing and parting the hair; and a substantially circular-cone-shaped tip-end elastically deformable part 36 that is provided contiguously to the tip end of the comb-tooth body part 35 and that is made of a flexible soft resin. A liquid introduction path 37 that is in communication with the hollow interior of the comb-teeth base 34 is formed inside each comb tooth 32. The liquid introduction path 37 opens at its tip end section, with a discharge port 37*a* being arranged in the vicinity of the tip-end elastically deformable part 36. The comb tooth 32 has branched discharge ports 37*b* at four points, the branched discharge ports branching off from the discharge port 37*a* of the liquid introduction path 37 in four directions and opening in the surfaces of the comb tooth 32.

Figure 10:
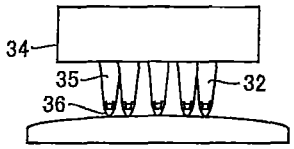
FIG. 10(1) is an explanatory diagram illustrating how a coating agent is applied with the hair-root applicator according to the other embodiment.
Figure 10:
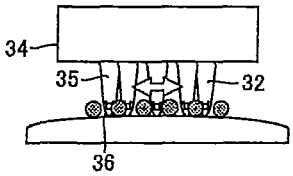
Figure 10:
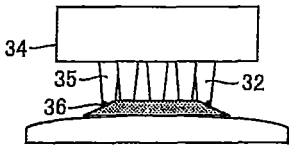

The same effects as those of the hair-root applicator 10 of the foregoing embodiment can be achieved also by the hair-root applicator 30 of this other embodiment. Further, in the hair-root applicator 30 of this other embodiment, the comb teeth 32 have a substantially circular-cone shape, and the flexible tip-end elastically deformable parts 36 at the tip end sections also have a substantially circular-cone shape. Thus, the tip-end elastically deformable parts 36 can be deformed so that they are pressed and flattened in any direction. In this way, as illustrated in FIG. 10 for example, the coating agent discharged from the discharge port 37*a* and the branched discharge ports 37*b* onto a narrow region of the scalp can be distributed and spread over a wide region of the scalp. Further, the massaging effect on the scalp can be improved.

The comb teeth 32 can apply the coating agent uniformly over a wide area, as illustrated in FIG. 10. Because the discharge port includes four branched discharge ports 37*b* (FIG. 10(1)), the coating agent spreads in a planar manner (FIG. 10(2)), and thus, it is possible to achieve a uniformly applied state over a wide area (FIG. 10(3)).

It should be noted that the present invention is not limited to the foregoing embodiments, and various modifications can be made. For example, the coating agent applied to the hair-root sections by the hair-root applicator of the present invention is not limited to hair dyes, and it is possible to employ other hair cosmetics, such as bleaches, and various other coating agents that are effective when applied to the hair-root sections and/or the scalp—such as scalp lotions, oils, hair tonics, hair restorers, and anti-dandruff agents.

Further, as a method for applying a coating agent by using the hair-root applicator of the present invention, it is possible to employ a method involving: applying a coating agent—which is preferably supplied to each comb tooth from a discharge port of a liquid introduction path inside each comb-tooth body part—by pressing the tip ends of respective tip-end elastically deformable parts against the scalp and elastically deforming the tip-end elastically deformable parts while combing the hair with the comb-tooth body parts.

Furthermore, as described above, the hair-root applicator of the present invention is an applicator including a comb-teeth part in which a plurality of comb teeth are erected from a surface of a comb-teeth base, and a container for containing a coating agent, wherein: the hair-root applicator is capable of applying, to hair-root sections of the hair, the coating agent supplied from the container to the comb teeth; each comb tooth includes a comb-tooth body part having a function of combing the hair, and a tip-end elastically deformable part that is provided contiguously to a tip end of the comb-tooth body part and that is made of a soft resin. From the viewpoint of the function of arranging the tip-end elastically deformable parts 16, 16' between hairs, the entire height-wise length of the comb tooth 12, 12', including the comb-tooth body part 15, 15' and the tip-end elastically deformable part 16, 16', is preferably from 10 to 25 mm, and more preferably from 12 to 20 mm. The height-wise length of the tip-end elastically deformable part 16, 16' is preferably from 1.0 to 5.5 mm, and more preferably from 2.0 to 5.0 mm. The ratio of the height-wise length of the tip-end elastically deformable part 16, 16' with respect to the entire length of the comb tooth 12, 12' is preferably from 0.05 to 0.5, and more preferably from 0.1 to 0.3. The spacing kept between adjacent comb teeth 12, 12' is preferably from 10 to 20 mm, and more preferably from 12 to 16 mm.

Figure 11:
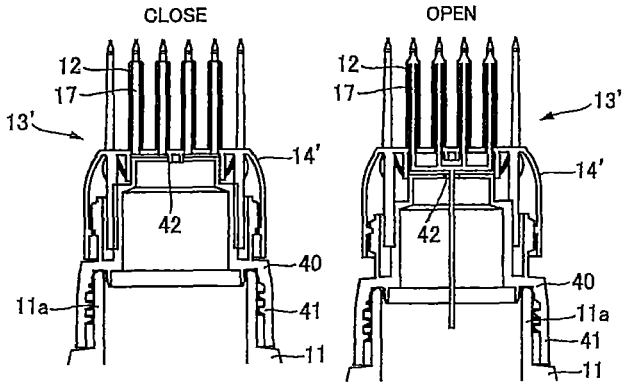
FIG. 11 is an explanatory diagram of a comb-teeth part having an opening/closing mechanism.

Moreover, in the hair-root applicator of the present invention, as illustrated in FIG. 11, a comb-teeth part 13' may be formed, for example, by: an intermediate cap 40 having an attachment skirt part 41 that is attached to the mouth/neck part 11*a* of a container 11; and a comb-teeth base 14' that is attached such that it can move up and down with respect to the intermediate cap 40. By moving the comb-teeth base 14' up and down with respect to the intermediate cap 40, this hair-root applicator can be used so as to be switchable between: an opened state in which a flow path leading from the interior of the container 11 to the liquid introduction paths 17 of the respective intermediate comb teeth 12 via a communication port 42 is opened; and a closed state in which the flow path via the communication port 42 is closed.

Although not illustrated in the drawings, this switching mechanism may be constructed by employing: a fitting structure in which the comb-teeth base 14' (comb-teeth part) and the intermediate cap 40 (container) are fitted together so that they can be pressed upward/downward with respect to one another by a sliding operation in the container's height direction; or a fitting structure in which the comb-teeth base 14' (comb-teeth part) and the intermediate cap 40 (container) are fitted together so that they can be pressed upward/downward with respect to one another by a twisting operation in the container's circumferential direction. The applicator may be configured such that: in a state where the comb-teeth part is pressed upward with respect to the container, the liquid introduction path of the container is connected with the liquid introduction path of the comb-teeth part; and in a state where the comb-teeth part is pressed downward with respect to the container, the liquid introduction path of the container body is disconnected from the liquid introduction path of the comb-teeth part.

In relation to the foregoing embodiments of the present invention, the following additional features (hair-root applicators and application methods) are further disclosed.

<1> A hair-root applicator comprising a comb-teeth part in which a plurality of comb teeth are erected from a surface of a comb-teeth base, and a container for containing a coating agent, the hair-root applicator being capable of applying, to hair-root sections of the hair, the coating agent supplied from the container to the comb teeth, wherein:

each comb tooth includes a comb-tooth body part having a function of combing the hair, and a tip-end elastically deformable part that is provided contiguously to a tip end of the comb-tooth body part and that is made of a soft resin;

the comb-tooth body part has a higher rigidity than the tip-end elastically deformable part, and has shape retainability with which it is possible to comb and part the hair;

a liquid introduction path for the coating agent is provided inside the comb-tooth body part; and a discharge port of the liquid introduction path is opened so as to be arranged in the vicinity of the tip-end elastically deformable part, or arranged so as to contact or overlap the tip-end elastically deformable part.

<2> The hair-root applicator as set forth in clause <1>, wherein the soft resin forming the tip-end elastically deformable part has a tensile strength of preferably from 1 to 10 MPa, and more preferably from 2 to 8 MPa.

<3> The hair-root applicator as set forth in clause <1> or <2>, wherein the tip-end elastically deformable part has a pointed shape in which the cross-sectional area of the elastic deformation part gradually decreases toward its tip end section.

<4> The hair-root applicator as set forth in any one of clauses <1> to <3>, wherein the comb-tooth body part has a tapered shape in which the cross-sectional area of the comb-tooth body part decreases from its base end section on the side of the comb-teeth base toward the tip-end elastically deformable part located at the tip end.

<5> The hair-root applicator as set forth in any one of clauses <1> to <4>, wherein the discharge port of the liquid introduction path of each comb tooth is arranged only on the tip-end side of the comb tooth.

<6> The hair-root applicator as set forth in any one of clauses <1> to <5>, wherein each comb tooth has a plurality of branched discharge ports that branch off from the discharge port of the liquid introduction path toward the tip-end side, and that each open in a surface of the comb tooth.

<7> The hair-root applicator as set forth in clause <6>, wherein: the comb-tooth body part has a flat transverse cross-sectional shape having a major axis and a minor axis; and the branched discharge ports are provided in a pair facing the minor-axis direction of the comb-tooth body part.

<8> The hair-root applicator as set forth in clause <7>, wherein: the comb teeth are arranged such that the major-axis directions of the respective comb-tooth body parts are parallel to one another, and the plurality of the comb teeth are provided so as to be lined up with spacings therebetween in the minor-axis directions of the respective comb-tooth body parts; and the plurality of the tip-end elastically deformable parts and the branched discharge ports are provided so as to be lined up on a single straight line along the minor-axis direction.

<9> The hair-root applicator as set forth in any one of clauses <1> to <8>, wherein the height-wise position where the discharge port is opened is included in a height-wise region that is preferably from 1.0 to 5.5 mm, more preferably from 1.5 to 4.0 mm, from the tip end of the tip-end elastically deformable part.

<10> The hair-root applicator as set forth in any one of clauses <1> to <9>, wherein:

the comb teeth are arranged such that the major-axis directions of the respective comb-tooth body parts are parallel to one another, and the plurality of the comb teeth are provided so as to be lined up with spacings therebetween in the minor-axis directions of the respective comb-tooth body parts;

the hair-root applicator includes an auxiliary-comb-teeth part that is removably attached to the comb-teeth part;

the auxiliary-comb-teeth part includes a plurality of auxiliary comb teeth that are erected from an auxiliary-comb-teeth base; and in a state where the auxiliary-comb-teeth part is attached to the comb-teeth base, the auxiliary comb teeth are arranged in a spacing between each pair of the comb teeth of the comb-teeth part that are adjacent to one another.

<11> The hair-root applicator as set forth in clause <10>, wherein, in a state where the auxiliary-comb-teeth part is attached to the comb-teeth base, the height-wise position of the tip end of the tip-end elastically deformable part of each comb tooth is the same as or above the height-wise position of the tip end of each auxiliary comb tooth.

<12> A hair-root applicator comprising a comb-teeth part in which a plurality of comb teeth are erected from a surface of a comb-teeth base, and a container for containing a coating agent, the hair-root applicator being capable of applying, to hair-root sections of the hair, the coating agent supplied from the container to the comb teeth, wherein:

each comb tooth includes a comb-tooth body part having a function of combing the hair, and a tip-end elastically deformable part that is provided contiguously to a tip end of the comb-tooth body part and that is made of a soft resin;

the comb-tooth body part has a higher rigidity than the tip-end elastically deformable part, and has shape retainability with which it is possible to comb and part the hair; and the ratio of the height-wise length of the tip-end elastically deformable part with respect to the entire length of the comb tooth is preferably from 0.05 to 0.35.

<13> A hair-root applicator comprising a comb-teeth part in which a plurality of comb teeth are erected from a surface of a comb-teeth base, and a container for containing a coating agent, the hair-root applicator being capable of applying, to hair-root sections of the hair, the coating agent supplied from the container to the comb teeth, wherein:

each comb tooth includes a comb-tooth body part having a function of combing the hair, and a tip-end elastically deformable part that is provided contiguously to a tip end of the comb-tooth body part and that is made of a soft resin;

the comb-tooth body part has a higher rigidity than the tip-end elastically deformable part, and has shape retainability with which it is possible to comb and part the hair; and the ratio of the height-wise length of the tip-end elastically deformable part with respect to the entire length of the comb tooth is preferably from 0.05 to 0.5.

<14> The hair-root applicator as set forth in any one of clauses <1> to <13>, wherein the longitudinal elastic modulus of the tip-end elastically deformable part is preferably from 0.5 to 50 MPa, more preferably from 1 to 40 MPa, and even more preferably from 3 to 30 MPa.

<15> The hair-root applicator as set forth in any one of clauses <1> to <14>, wherein the difference in tensile strength between the comb-tooth body part and the tip-end elastically deformable part is preferably from 5 to 40 MPa, more preferably from 10 to 35 MPa, and even more preferably from 15 to 35 MPa.

<16> The hair-root applicator as set forth in any one of clauses <1> to <15>, wherein the difference between the tensile modulus of elasticity of the comb-tooth body part and the longitudinal elastic modulus of the tip-end elastically deformable part is preferably from 200 MPa to 1950 MPa, more preferably from 400 MPa to 1460 MPa, and even more preferably from 800 to 1460 MPa.

<17> The hair-root applicator as set forth in any one of clauses <1> to <16>, wherein the tensile modulus of elasticity of the comb-tooth body part is preferably from 200 MPa to 2000 MPa inclusive, more preferably from 400 MPa to 1500 MPa inclusive, and even more preferably from 800 MPa to 1500 MPa inclusive.

<18> The hair-root applicator as set forth in any one of clauses <1> to <17>, wherein the comb-tooth body part and the tip-end elastically deformable part are provided by being formed continuously and integrally.

<19> The hair-root applicator as set forth in any one of clauses <1> to <18>, wherein the comb-tooth body part and the tip-end elastically deformable part are molded continuously and integrally by coinjection molding or insert molding.

<20> The hair-root applicator as set forth in any one of clauses <1> to <19>, wherein the viscosity of the coating agent at 30° C. is preferably 3 mPa·s or greater—more preferably 5 mPa·s or greater, even more preferably 500 mPa·s or greater, and even more preferably 1000 mPa·s or greater—and preferably 30000 mPa·s or less—more preferably 20000 mPa·s or less, and even more preferably 15000 mPa·s or less.

<21> The hair-root applicator as set forth in any one of clauses <1> to <20>, wherein:

the container for containing the coating agent and the comb-teeth part have: a fitting structure in which the comb-teeth part and the container are fitted together so that they can be pressed upward/downward with respect to one another by a sliding operation in the container's height direction; or a fitting structure in which the comb-teeth part and the container are fitted together so that they can be pressed upward/downward with respect to one another by a twisting operation in the container's circumferential direction;

in a state where the comb-teeth part is pressed upward with respect to the container, a liquid introduction path of the container is connected with a liquid introduction path of the comb-teeth part; and in a state where the comb-teeth part is pressed downward with respect to the container, the liquid introduction path of the container body is disconnected from the liquid introduction path of the comb-teeth part.

<22> The hair-root applicator as set forth in any one of clauses <1> to <21>, wherein the container is an aerosol container or a squeezable container.

<23> The hair-root applicator as set forth in any one of clauses <1> to <22>, wherein the comb-tooth body part and the tip-end elastically deformable part are colored so as to have different colors.

<24> The hair-root applicator as set forth in any one of clauses <1> to <23>, wherein: the comb-tooth body part has a flat, horizontally-long transverse cross-sectional shape having a major axis and a minor axis; each comb tooth has a plurality of branched discharge ports that branch off from the discharge port of the liquid introduction path toward the tip-end side, and that each open in a surface of the comb tooth; the branched discharge ports are provided in a pair facing the minor-axis direction of the comb-tooth body part; and the ratio of the inner diameter of the liquid introduction path to the width, in the minor-axis direction, of the comb-tooth body part is preferably from 0.2 to 0.75, and more preferably from 0.5 to 0.7.

<25> The hair-root applicator as set forth in any one of clauses <1> to <24>, wherein the area of the opening of the discharge port is preferably from 0.77 to 7.06 $mm^2$, and more preferably from 1.0 to 3.5 $mm^2$.

<26> The hair-root applicator as set forth in any one of clauses <1> to <25>, wherein the comb-tooth body part preferably has, in the vicinity of the tip-end elastically deformable part, a stepped part in which the width of the comb-tooth body part is narrowed.

<27> The hair-root applicator as set forth in any one of clauses <1> to <26>, wherein: the comb-teeth base has a cylindrical shape; and the comb teeth are arranged concentrically on the comb-teeth base.

<28> The hair-root applicator as set forth in clause <27>, wherein the comb teeth include: a comb tooth arranged in the center; and a plurality of comb teeth arranged concentrically about the central comb tooth.

<29> The hair-root applicator as set forth in clause <27> or <28>, wherein: a liquid introduction path that is in communication with the hollow interior of the comb-teeth base is formed inside each comb tooth; and the comb tooth has branched discharge ports at four points, the branched discharge ports branching off from the discharge port of the liquid introduction path in four directions and opening in the surfaces of the comb tooth.

<30> The hair-root applicator as set forth in any one of clauses <1> to <29>, wherein the soft resin forming the tip-end elastically deformable part is: preferably one type of resin, or a mixture of two or more types of resins, selected from elastic resin materials or soft resin materials including a rubber component or elastomer component; more preferably a resin/resins including at least one type of rubber component or elastomer component selected from polystyrene, polyolefins, polyesters, polyurethane, urethane rubber, and silicone rubber; and even more preferably an elastomer including polystyrene.

<31> The hair-root applicator as set forth in any one of clauses <1> to <30>, wherein the synthetic resin forming the comb-tooth body part is preferably a synthetic resin that includes at least one type of resin selected from medium-density polyethylene, high-density polyethylene, and polypropylene.

<32> The hair-root applicator as set forth in any one of clauses <1> to <31>, wherein the coating agent is a hair dye.

<33> The hair-root applicator as set forth in any one of clauses <1> to <32>, wherein: the tip-end elastically deformable part preferably has a pointed shape in which the cross-sectional area of the elastic deformation part gradually decreases toward its tip end section; and the tip-end shape of the tip-end elastically deformable part is rounded in a curved shape.

<34> An application method using a hair-root applicator including a comb-teeth part in which a plurality of comb teeth are erected from a surface of a comb-teeth base, and a container for containing a coating agent, the hair-root applicator being capable of applying, to hair-root sections of the hair, the coating agent supplied from the container to the comb teeth, wherein:

each comb tooth includes a comb-tooth body part having a function of combing the hair, and a tip-end elastically deformable part that is provided contiguously to a tip end of the comb-tooth body part and that is made of a soft resin;

the comb-tooth body part has a higher rigidity than the tip-end elastically deformable part, and has shape retainability with which it is possible to comb and part the hair; and the application method involves applying the coating agent which is supplied from a discharge port of the liquid introduction path in each comb-tooth body part to the vicinity of each tip-end elastically deformable part, by pressing the tip ends of the respective tip-end elastically deformable parts against the scalp and elastically deforming the tip-end elastically deformable parts while combing the hair with the comb-tooth body parts.

INDUSTRIAL APPLICABILITY

With the hair-root applicator of the present invention, coating agents—such as hair cosmetics, e.g. hair dye, and other agents—can be applied stably and efficiently in a concentrated manner, even in hair-root sections where it is difficult for the user to see the undyed regions with his/her eyes—e.g. in hair-root sections at the top and back of the head.

The invention claimed is:

1. A hair-root applicator comprising a comb-teeth part in which a plurality of comb teeth are erected from a surface of a comb-teeth base, and a container for containing a coating agent, the comb-teeth base attached to said container, the hair-root applicator being capable of applying, to hair-root sections of hair, the coating agent supplied from the container to the comb teeth, wherein:

each comb tooth includes a comb-tooth body part having a function of combing the hair, and a tip-end elastically deformable part that is provided contiguously to a tip end of the comb-tooth body part and that is made of a soft resin;

the comb-tooth body part has a higher rigidity than the tip-end elastically deformable part, and has shape retainability with which it is possible to comb and part the hair;

a liquid introduction path for the coating agent is provided inside the comb-tooth body part;

a discharge port of the liquid introduction path is opened so as to be arranged in the vicinity of the tip-end elastically deformable part, or arranged so as to contact or overlap the tip-end elastically deformable part;

each comb tooth has a plurality of branched discharge ports that branch off from the discharge port of the liquid introduction path, and that each open in a surface of the comb tooth;

the comb-tooth body part has a flat transverse cross sectional shape having a major axis and a minor axis;

the branched discharge ports are provided in a pair facing the minor-axis direction of the comb-tooth body part;

the hair-root applicator includes an auxiliary-comb-teeth part that is removably attached to the comb-teeth part;

the auxiliary-comb-teeth part includes a plurality of auxiliary comb teeth that are erected from an auxiliary-comb-teeth base; and where the auxiliary-comb-teeth part is attached to the comb-teeth base, the auxiliary comb teeth are arranged in a spacing between each pair of the comb teeth of the comb-teeth part that are adjacent to one another in the minor-axis direction.

2. The hair-root applicator according to claim 1, wherein the soft resin forming the tip-end elastically deformable part has a tensile strength of from 1 to 10 MPa.

3. The hair-root applicator according to claim 1, wherein the tip-end elastically deformable part has a pointed shape in which the cross-sectional area of the elastic deformation part gradually decreases toward its tip end section.

4. The hair-root applicator according to claim 1, wherein the comb-tooth body part has a tapered shape in which the cross-sectional area of the comb-tooth body part decreases from its base end section on the side of the comb-teeth base toward the tip-end elastically deformable part located at the tip end.

5. The hair-root applicator according to claim 1, wherein the discharge port of the liquid introduction path of each comb tooth is arranged only on the tip-end side of the comb tooth.

6. The hair-root applicator according to claim 1, wherein:

the comb teeth are arranged such that the major-axis directions of the respective comb-tooth body parts are parallel to one another, and the plurality of the comb teeth are provided so as to be lined up with spacings therebetween in the minor-axis directions of the respective comb-tooth body parts; and the plurality of the tip-end elastically deformable parts and the branched discharge ports are provided so as to be lined up on a single straight line along the minor-axis direction.

7. The hair-root applicator according to claim 1, wherein a height-wise position where the discharge port is opened is included in a height-wise region that is from 1.0 to 5.5 mm from the tip end of the tip-end elastically deformable part.

8. The hair-root applicator according to claim 1, wherein, where the auxiliary-comb-teeth part is attached to the comb-teeth base, a height-wise position of the tip end of the tip-end elastically deformable part of each comb tooth is the same as or above the height-wise position of the tip end of each auxiliary comb tooth.

9. The hair-root applicator according to claim 1, wherein the difference in tensile strength between the comb-tooth body part and the tip-end elastically deformable part is from 5 to 40 MPa.

10. The hair-root applicator according to claim 1, wherein the comb-tooth body part and the tip-end elastically deformable part are provided by being formed continuously and integrally.

11. The hair-root applicator according to claim 10, wherein the comb-tooth body part and the tip-end elastically deformable part are molded continuously and integrally by coinjection molding or insert molding.

12. The hair-root applicator according to claim 1, wherein the viscosity of the coating agent at 30° C. is from 3 to 30000 mPa·s.

13. The hair-root applicator according to claim 1, wherein:

the container for containing the coating agent and the comb-teeth part have: a fitting structure in which the comb-teeth part and the container are fitted together so that they can be pressed upward/downward with respect to one another by a sliding operation in the container's height direction; or a fitting structure in which the comb-teeth part and the container are fitted together so that they can be pressed upward/downward with respect to one another by a twisting operation in the container's circumferential direction;

where the comb-teeth part is pressed upward with respect to the container, a liquid introduction path of the container is connected with a liquid introduction path of the comb-teeth part; and where the comb-teeth part is pressed downward with respect to the container, the liquid introduction path of the container body is disconnected from the liquid introduction path of the comb-teeth part.

14. The hair-root applicator according to claim 13, wherein the container is an aerosol container or a squeezable container.

15. An application method using a hair-root applicator according to clam 1, the application method comprises applying the coating agent which is supplied from a discharge port of the liquid introduction path in each comb-tooth body part to the vicinity of each tip-end elastically deformable part, by pressing the tip ends of the respective tip-end elastically deformable parts against the scalp of the user and elastically deforming the tip-end elastically deformable parts while combing the hair with the comb-tooth body parts.

* * * * *